United States Patent [19]

Pettit

[11] Patent Number: 4,907,389

[45] Date of Patent: Mar. 13, 1990

[54] LATTICE WITH INTERLOCKING DOVETAILS

[76] Inventor: Frederick M. Pettit, 1411 Point Abino Rd. S., Ridgeway, Ontario LOS 1N0, Canada

[21] Appl. No.: 146,380

[22] Filed: Jan. 22, 1988

Related U.S. Application Data

[63] Continuation-in-part of Ser. No. 104,244, Oct. 5, 1987, abandoned.

[51] Int. Cl.[4] ..... E04C 2/42

[52] U.S. Cl. ..... 52/668; 52/748; 403/346

[58] Field of Search ..... 52/666, 668; 403/346, 403/382, 209

[56] References Cited

U.S. PATENT DOCUMENTS

| | | | |
|---|---|---|---|
| 548,998 | 10/1895 | Mannesmann | 403/346 X |
| 3,748,814 | 7/1933 | Cribben | 52/668 |
| 3,927,950 | 12/1975 | Herrmann et al. | 52/668 X |
| 4,060,950 | 12/1977 | Rackard et al. | 52/668 X |
| 4,145,858 | 3/1979 | Dovman | 52/668 X |

*Primary Examiner*—Carl D. Friedman

*Attorney, Agent, or Firm*—Joseph P. Gastel

[57] ABSTRACT

A lattice consisting of first and second flexible resilient criss-crossed strips each having beveled edges and mating dovetail cutouts oriented in face-to-face relationship with the dovetail cutouts of each of the strips having dovetail sides engaging the beveled edges of the other of the strips. A lattice with criss-crossed strips with one strip having dovetail cutouts with sides which engage mating beveled edges of the other strip. Lattice structures of the foregoing types which utilize hollow strips.

21 Claims, 4 Drawing Sheets

Fig. 24.
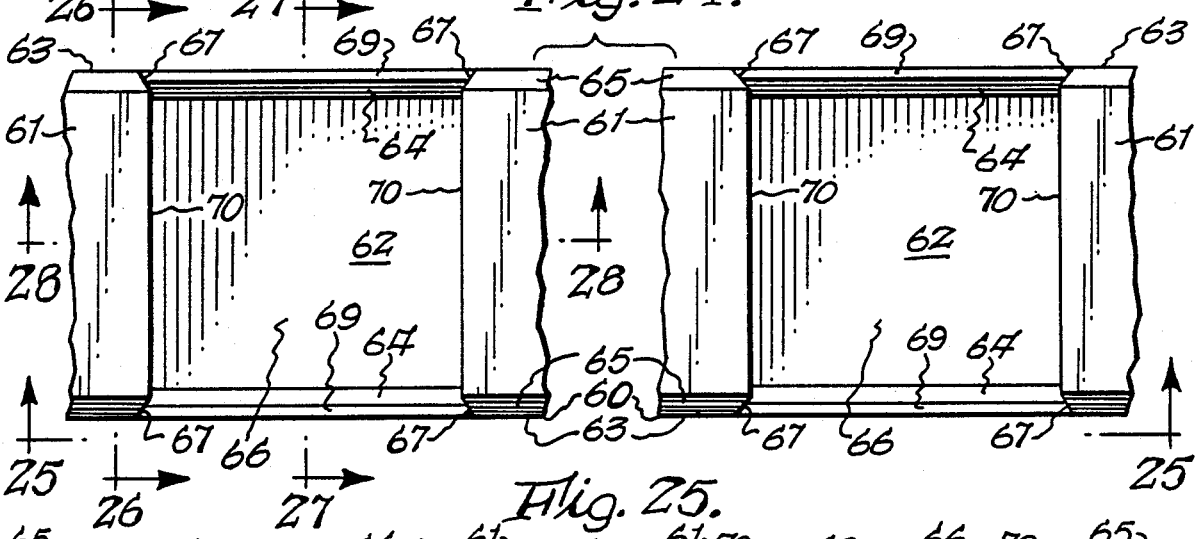
Fig. 25.
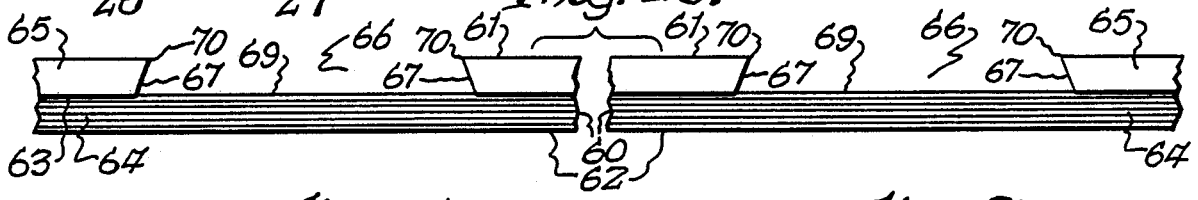
Fig. 26.
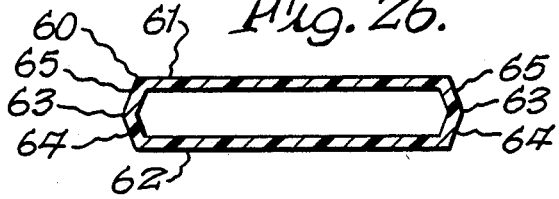
Fig. 27.
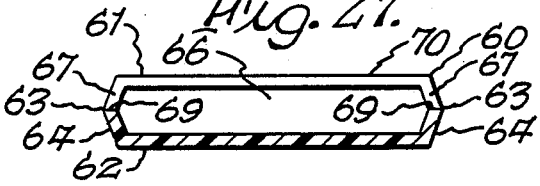
Fig. 28.
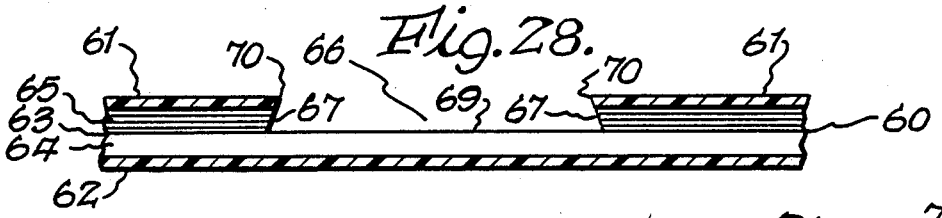
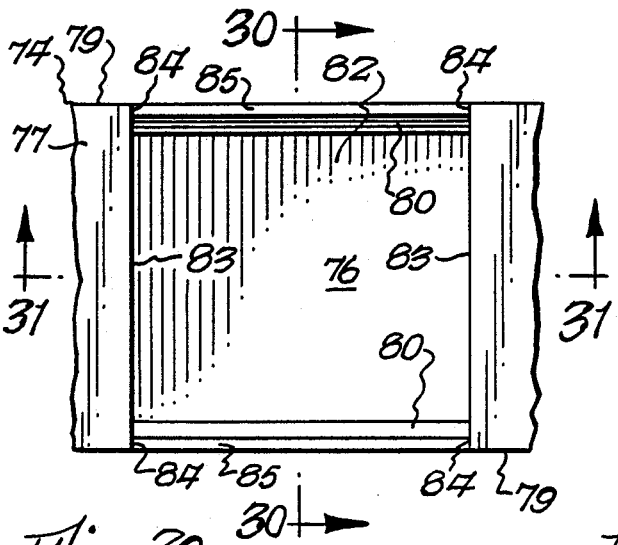
Fig. 29.
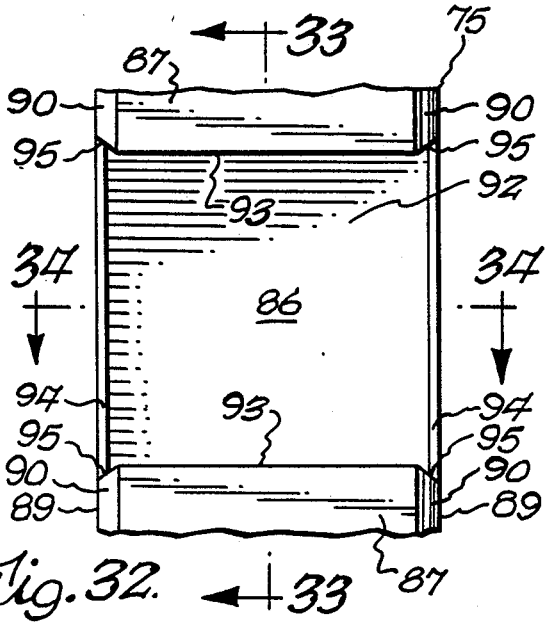
Fig. 32.

Fig. 30.
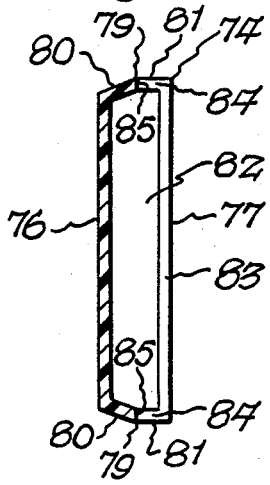
Fig. 33.
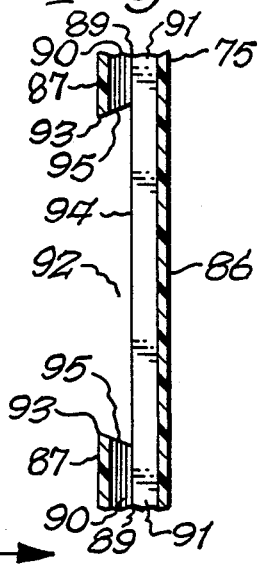
Fig. 34.
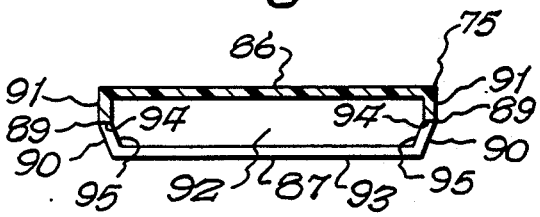
Fig. 31.
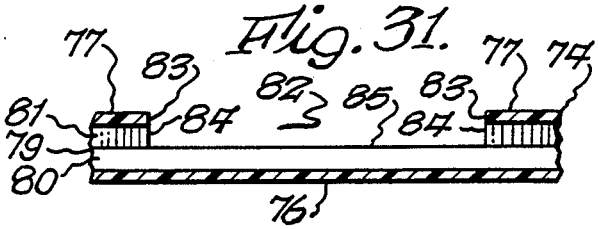
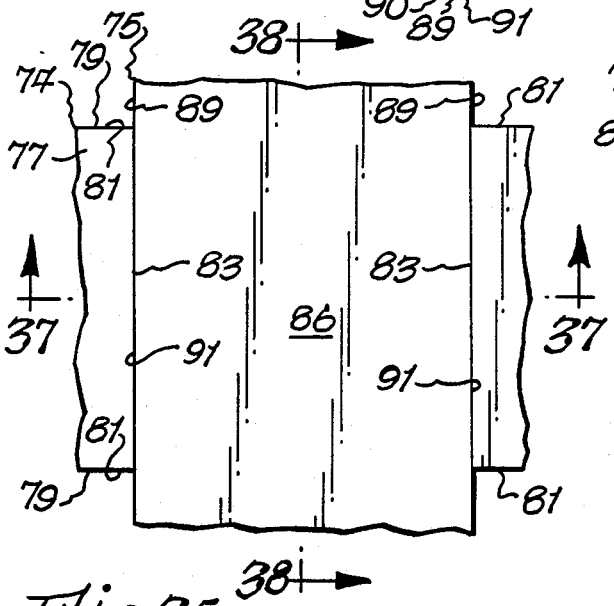
Fig. 35.
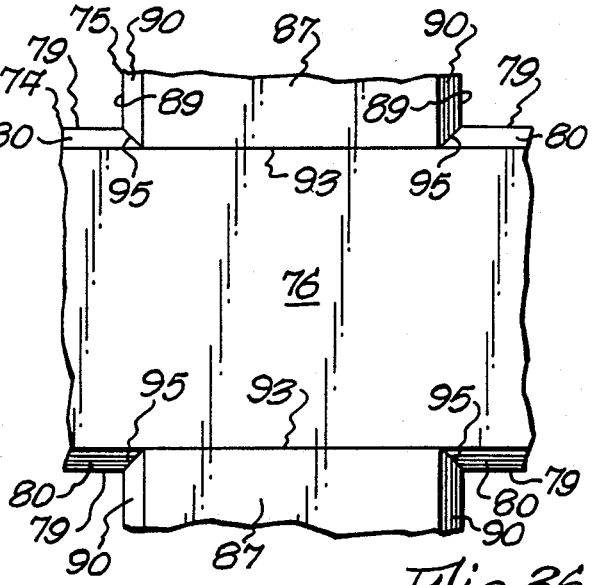
Fig. 36.
Fig. 37.
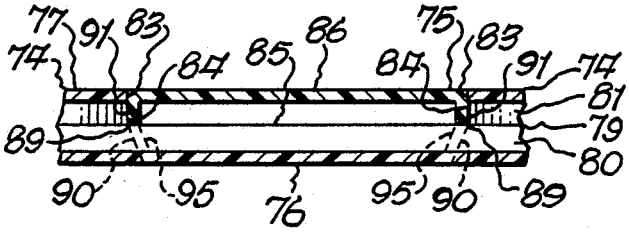
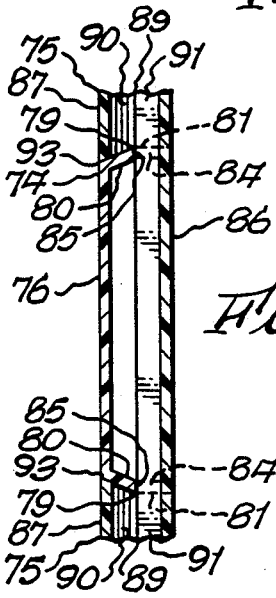
Fig. 38.

LATTICE WITH INTERLOCKING DOVETAILS

CROSS REFERENCE TO RELATED APPLICATION

The present application is a continuation-in-part of application Ser. No. 104,244, filed Oct. 5, 1987.

BACKGROUND OF THE INVENTION

The present invention relates to an improved lattice construction, a method of assembling the lattice, and to a method of fabricating strips therefor.

By way of background, insofar as known, lattices are fabricated by nailing, gluing or interweaving elongated strips in a criss-cross orientation. All of the foregoing lattices either had to be shipped in assembled condition or required labor intensive effort to assemble them if they were shipped in a disassembled state.

SUMMARY OF THE INVENTION

It is one object of the present invention to provide an improved lattice structure which can be shipped as strips in a disassembled condition and which can be assembled without tools, fasteners or interweaving in an extremely simple manner by snapping the strips together in an orientation which is predetermined by the structure of the strips themselves.

Another object of the present invention is to provide an improved lattice structure which when once snapped together cannot be separated by forces, such as the wind, applied to only one side thereof, the separation being possible only by simultaneously bending the criss-crossing strips in opposite directions.

Yet another object of the present invention is to provide an improved dovetail joint structure for crossing strips which comprises either a double dovetail interlocked joint or a single dovetail joint.

A further object of the present invention is to provide an improved lattice structure which is uniquely suitable for fabrication out of flexible resilient plastic strips which can be assembled with each other without cracking or splitting and which will provide the attendant advantages characteristic of plastic, namely, being weather-proof and never needing painting.

Still another object of the present invention is to provide an improved method for fabricating dovetail cutouts in plastic strips used for lattices.

A still further object of the present invention is to provide an improved method for assembling strips with either a single dovetail interlocking joint or a double dovetail interlocking joint.

Yet another object of the present invention is to provide improved lattice structures which achieve the foregoing objects and which additionally are fabricated from hollow plastic strips to reduce the cost without diminishing the utility. Other objects and attendant advantages of the present invention will readily be perceived hereafter.

The present invention relates to a self-retaining interlocked lattice comprising a plurality of first strips each having a first longitudinal axis and a first front surface and a first rear surface and first opposite edges, said first opposite edges of each of said strips including first opposite edge portions which diverge away from each other as they extend from said first rear surface toward said first front surface, a plurality of cutouts each of which extend inwardly into said each first strip from said front surface and which extend across said first opposite edges and which terminate at a first inner surface on said first strip, a plurality of second strips each having a second longitudinal axis and a second front surface and a second rear surface and second opposite edges, a plurality of spaced dovetail cutouts each of which extend inwardly into each second strip from said second front surface and extend across said second opposite edges and which terminate at a second inner surface on said second strip, said first and second strips being oriented with said first and second longitudinal axes transverse to each other and with each of said cutouts and each of said dovetail cutouts oriented with said first and second inner surfaces facing each other and with a portion of said first strip in each of said dovetail cutouts and a portion of said second strip in each of said cutouts and with said dovetail sides of each of said dovetail cutouts of said second strips in locking engagement with said diverging edge portions of said first strips. The lattice may consist of hollow criss-crossed strips.

The present invention also relates to a method of making and assembling a dovetail joint comprising the steps of providing a flexible resilient first strip having a first longitudinal axis, providing a second strip having a second longitudinal axis, forming a dovetail cutout in said flexible resilient strip in a direction transverse to said longitudinal axis with said dovetail cutout having dovetail sides, forming a cutout in said second strip transverse to said longitudinal axis, forming diverging edge portions on said second strip, placing said dovetail cutout of said flexible resilient strip in facing relationship to said cutout of said second strip, applying a bending force to said flexible resilient strip in a direction away from said second strip to thereby open said dovetail sides, effecting relative movement between said first and second strips so that said second strip moves into said dovetail cutout of said flexible resilient strip and said flexible resilient strip moves into said cutout of said second strip, and releasing said bending force from said flexible resilient strip to thereby cause said dovetail sides of said flexible resilient strip to engage said diverging edge portions of said second strip.

The present invention also relates to a method of forming a dovetail in a plastic strip comprising providing a plastic strip made of compressible material and having an upper surface, heating said strip, impressing a tool with opposite sides into said upper surface of said strip to initially form a depression having opposite sides which do not diverge from said upper surface, and causing said opposite sides of said tool to move apart to cause said opposite sides of said depression to diverge from said upper surface to thereby form a dovetail in said plastic strip.

The various aspects of the present invention will be more fully understood when the following portions of the specification are read in conjunction with the accompanying drawings wherein:

BRIEF DESCRIPTION OF THE DRAWINGS

FIG. 24 is a fragmentary plan view of one form of hollow strips which can be utilized for fabricating the improved lattice of the present invention with a double dovetail interlocking joint;

FIG. 25 is a fragmentary side elevational view taken substantially in the direction of arrows 25—25 of FIG. 24;

FIG. 26 is a cross sectional view taken substantially along line 26—26 of FIG. 24;

FIG. 27 is a cross sectional view taken substantially along line 27—27 of FIG. 24;

FIG. 28 is a fragmentary cross sectional view taken substantially along line 28—28 of FIG. 24;

FIG. 29 is a fragmentary plan view of one strip of another hollow strip embodiment of the present invention for fabricating the improved lattice of the present invention with a single dovetail interlocking joint;

FIG. 30 is a cross sectional view taken substantially along line 30—30 of FIG. 29;

FIG. 31 is a fragmentary cross sectional view taken substantially along line 31—31 of FIG. 29;

FIG. 32 is a fragmentary plan view of a hollow strip which mates with the hollow strip of FIG. 29 to provide a single dovetail interlock joint;

FIG. 33 is a fragmentary cross sectional view taken substantially along line 33—33 of FIG. 32;

FIG. 34 is a cross sectional view taken substantially along line 34—34 of FIG. 32 but inverted 180° from the position shown in FIG. 32;

FIG. 35 is a fragmentary top plan view of the strips of FIGS. 29 and 32 in mating relationship;

FIG. 36 is a fragmentary bottom plan view of the strips of FIG. 35;

FIG. 37 is a fragmentary cross sectional view taken substantially along line 37—37 of FIG. 35; and FIG. 38 is a fragmentary cross sectional view taken substantially along line 38—38 of FIG. 35.

DESCRIPTION OF THE PREFERRED EMBODIMENTS

The lattice 10 of the present invention includes a plurality of horizontal strips 11 which intersect with and are locked to a plurality of vertical strips 12 by means of double dovetail interlocking joints 13. While only two horizontal and two vertical strips are shown by way of example, it will be appreciated that any number of horizontal and vertical strips can be assembled in situ in accordance with the present invention to provide the desired interlocking lattice which can be used for fences, partitions, dividers, and the like, or for any other use for which lattices may be desired.

Figures 1, 2, 3, 4, 5, 6, 7, 8, 9, 10, 11:
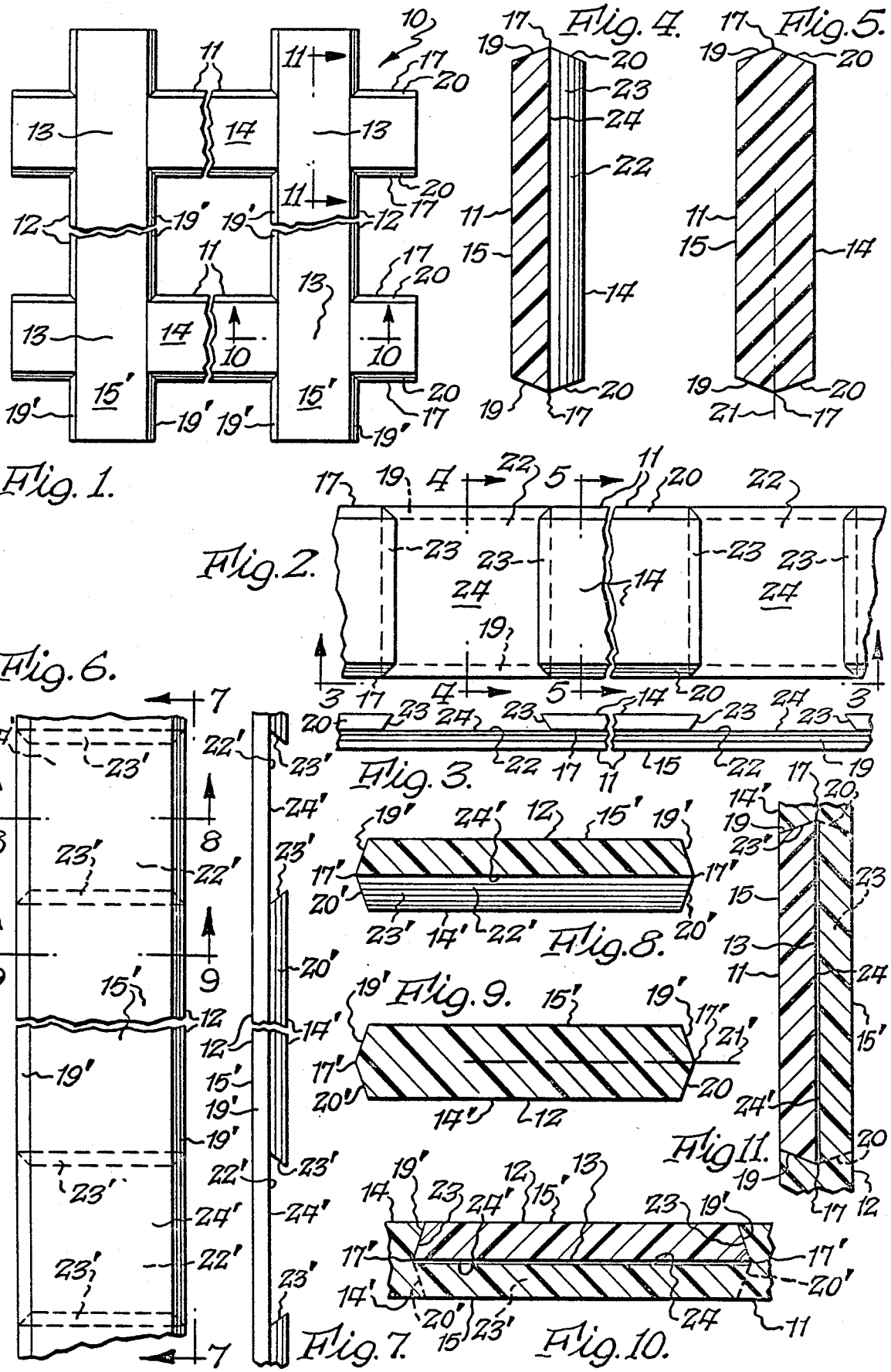
FIG. 1 is a fragmentary plan view of one embodiment of the self-retaining double dovetail interlocking lattice of the present invention.
FIG. 2 is an enlarged fragmentary plan view of a horizontal strip of the lattice of FIG. 1.
FIG. 3 is a side elevational view taken substantially in the direction of arrows 3—3 of FIG. 2.
FIG. 4 is an enlarged cross sectional view taken substantially along line 4—4 of FIG. 2.
FIG. 5 is an enlarged cross sectional view taken substantially along line 5—5 of FIG. 2.
FIG. 6 is an enlarged fragmentary plan view of a vertical strip of the lattice of FIG. 1.
FIG. 7 is a side elevational view taken substantially in the direction of arrows 7—7 of FIG. 6.
FIG. 8 is an enlarged cross sectional view taken substantially along line 8—8 of FIG. 6.
FIG. 9 is an enlarged cross sectional view taken substantially along line 9—9 of FIG. 6.
FIG. 10 is an enlarged fragmentary cross sectional view taken substantially along line 10—10 of FIG. 1 and showing a joint between a horizontal and vertical strip.
FIG. 11 is an enlarged cross sectional view taken substantially along line 11—11 of FIG. 1 and showing the joint between a horizontal and vertical strip.

Horizontal strips 11 each include a front surface 14, a rear surface 15, and opposite side edges 17. The opposite side edges 17 include side edge portions 19 which diverge away from rear surface 15 and they also include side edge portions 20 which diverge away from front surface 14. Diverging side edge portions 19 and 20 are inclined at the same angle and are of the same width. In other words, side edge portions 19 and 20 are symmetrical to centerline 21 (FIG. 5). A plurality of spaced dovetail cutouts 22 extend inwardly into each horizontal strip from its front surface 14, and each dovetail cutout includes opposed dovetail sides 23 which extend between upper surface 14 and inner surface 24.

Vertical strips 12, in the embodiment of FIG. 1, are identical to horizontal strips 11, and identical parts will be designated by primed numerals which correspond to the unprimed numerals of horizontal strips 11. More specifically, vertical strips 12 each include a front surface 14', a rear surface 15', and opposite side edges 17'. The opposite side edges 17' include side edge portions 19' which diverge away from rear surface 15', and they also include side edge portions 20' which diverge away from front surface 14. Diverging side edge portions 19' and 20' are inclined at the same angle and are of the same width. In other words, side edge portions 19' and 20' are symmetrical to centerline 21' (FIG. 9). A plurality of spaced dovetail cutouts 22' extend inwardly into each horizontal strip 12 from its front surface 14', and each dovetail cutout includes opposed dovetail sides 23' which extend between upper surface 14' and inner surface 24'.

The horizontal strips 11 are interlocked with vertical strips 12 because dovetail sides 23 of horizontal strips 11 engage diverging side portions 19' of vertical strips 12, and dovetail sides 23' of vertical strips 12 engage diverging side portions 19 of horizontal strips 11. Inner surfaces 24 and 24' are in substantial abutting relationship. Thus, good strong joints 13 between the horizontal strips 11 and vertical strips 12 are obtained without the use of fasteners or glue, especially considering the complementary mating relationship between the dovetail sides of each strip engaging the contiguous side edge portions of the other strip. This complementary mating relationship is obtained because of the same angle of inclination of the dovetail sides and the side edge portions of the strips.

Figures 12, 13, 14, 15, 16, 17, 18, 19, 20, 21, 22, 23:
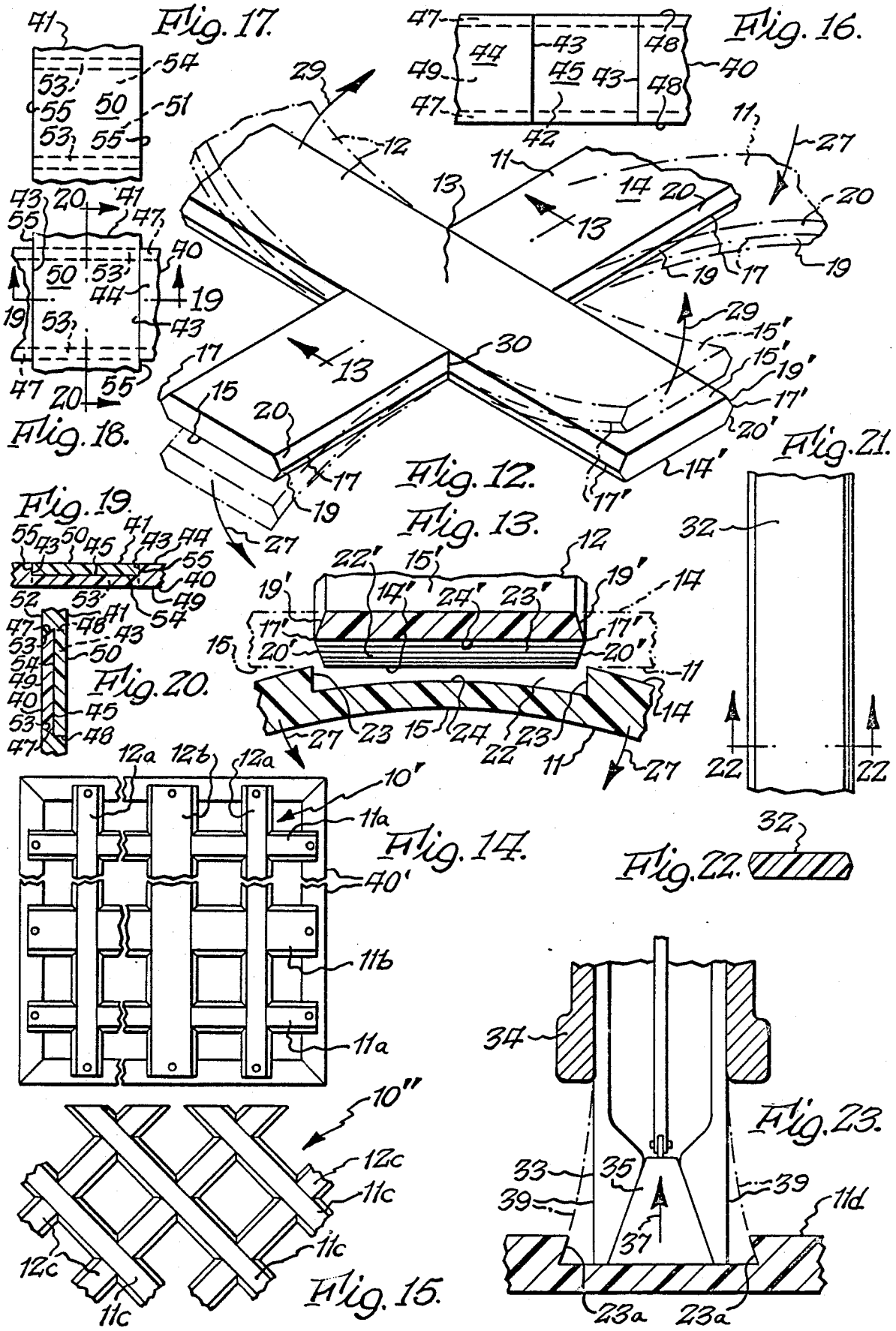
FIG. 12 is a fragmentary perspective view showing how the vertical and horizontal strips are bent in opposite directions to assemble the double dovetail interlocking connection therebetween.
FIG. 13 is a fragmentary cross sectional view taken substantially along line 13—13 of FIG. 12.
FIG. 14 is a fragmentary plan view of an alternate embodiment of the present invention utilizing both horizontal and vertical strips of varying width.
FIG. 15 is a fragmentary plan view of another embodiment of the present invention showing the intersecting strips oriented diagonally.
FIG. 16 is a fragmentary plan view of a lattice strip for a modified embodiment of the present invention.
FIG. 17 is a fragmentary plan view of a lattice strip which locks with the strip of FIG. 16.
FIG. 18 is a fragmentary plan view of the strips of FIGS. 16 and 17 in interlocked engagement.
FIG. 19 is a fragmentary cross sectional view of the joint of FIG. 18 taken substantially along line 19—19 of FIG. 18.
FIG. 20 is a fragmentary cross sectional view taken substantially along line 20—20 of FIG. 18.
FIG. 21 is a fragmentary plan view of a plastic bar into which the dovetail cutouts are formed.
FIG. 22 is a cross sectional view taken substantially along line 22—22 of FIG. 21.
FIG. 23 is a fragmentary side elevational view schematically showing the method by which dovetail cutouts can be impressed in the plastic bar of FIGS. 21 and 22.

The manner in which each joint 13 is assembled is depicted in FIGS. 12 and 13. Each strip 11 and 12 is flexible and resilient. Thus, when strip 11 is bent rearwardly in the direction of arrows 27 to the dotted line position of FIG. 12, the dovetail sides 23 will assume a more opened position, as shown in FIG. 13. The same occurs when strip 12 is bent in the direction of arrows 29 to the dotted line position of FIG. 12. Thus, the two dovetails 22 and 22' can be superimposed on each other with their inner surfaces 24 and 24' in touching relationship, and when resilient members 11 and 12 are thereafter released, they will return to the solid line positions shown in FIG. 12 wherein a double dovetail interlocking joint 13 is obtained. With the above described geometry of strips 11 and 12, surface 14 will be substantially flush with surface 15' and surface 15 will be substantially flush with surface 14'. In addition, because of the above-described geometry, perfectly mitered joints 30 are obtained at each of the four corners of the joint 13.

In FIG. 14 an alternate embodiment 10' is shown consisting of horizontal strips 11*a* and 11*b* and vertical strips 12*a* and 12*b*. The only difference between the embodiment of FIG. 1 and the embodiment of FIG. 14 is that strips 11*b* and 12*b*, which are of equal width, are wider than strips 11*a* and 12*a*, which are of equal width. It will be understood that the dovetail cutouts of strips 11*a*, 11*b*, 12*a* and 12*b* have to be dimensioned to receive their mating strips. It will further be appreciated that a lattice can be made of any numbers of strips of varying width, depending on the pattern which is desired.

In FIG. 15, another embodiment 10" of the present invention is disclosed wherein diagonal strips 11*c* are secured to diagonal strips 12*c* by interfitting dovetail connections of the type described in detail above. Here again, the strips may be of varying widths, as described above relative to FIG. 14.

It is to be noted that all of the intersecting strips of FIGS. 1, 14 and 15 are at right angles to each other. However, the present invention is not limited to this orientation because the crossing strips may extend at any desired angle relative to each other. The only restriction is that the strips designated by the general numeral 11 should be parallel to each other and the intersecting strips designated by the general numeral 12 should also be parallel to each other.

In FIGS. 21–23 one method of fabricating strips which form the double dovetail interlocking lattice is disclosed. The method is initiated by forming a strip 32 of the cross section shown in FIG. 22 by extrusion or in any other suitable manner. The strip is preferably formed of compressible cellular polyvinyl chloride which is of sufficient elasticity and resilience so that it can be bent as shown in FIGS. 12 and 13 and which will return to its original shape when the bending force is released. Because the polyvinyl chloride is cellular, it can be compressed, after being heated, by the die 33 of FIG. 23 which is located within collar 34. After the die is sunk into strip 11*d* to the extent indicated, mandrel 35 is moved in the direction of arrow 37 to spread die sides 39 to the dotted line position to thereby produce dovetail sides 23*a*. Thereafter, mandrel 35 is moved downwardly to permit die sides 39 to return to their solid-line position and the die 33 is withdrawn. The reason the foregoing can be done is because the polyvinyl chloride material is cellular and can be compressed. A suitable polyvinyl chloride material which can be used is known under the trade name GEON and is obtainable from the B. F. Goodrich Company. It will also be appreciated that the dovetail cutouts can be milled into the strips or can be fabricated into the strips in any other desired manner. However, the above described method of FIG. 18 is preferred.

As noted above, the joints 13 are assembled by bending the intersecting strips in opposite directions to cause the dovetail cutouts to interfit and thereafter releasing the resilient intersecting strips so that the dovetail sides of each strip lock to edge portions of the other strip.

When the lattice work is used for fences or any other structures which are subjected to wind forces or other forces on opposite sides of the lattice, the joints of the lattice cannot be separated because the wind force, or any other force, will be applied only to one side at any given time. Thus, while only one of the strips will tend to open up its dovetail cutout, the other strip will tighten its grip. This occurs in both directions. The only way in which the joints 13 can be separated is by bending the strips in opposite directions as disclosed above in FIG. 12 and then pulling the strips away from each other.

In addition to the foregoing, once the lattice work is attached to opposite sides of a frame, bending of the strips is virtually impossible so that their joints cannot be separated. A frame 40' is shown in FIG. 14 for purposes of illustration, but it is understood that a frame can be used with any of the other embodiments.

While the foregoing description has disclosed embodiments having a double dovetail interlocking joint, it will be appreciated that the present invention can be modified so that it can have only a single dovetail interlocking joint wherein only the first strip possesses a dovetail cutout and the second strip has a plain cutout which receives the first strip and the second strip also has the diverging edge portions which are engaged by the dovetail sides. The method of assembling the first and second strips is by bending the one with the dovetail, as shown in FIG. 12, and interfitting it with the second strip by inserting into the cutout of the second strip and permitting the first strip to unbend and clamp onto the diverging sides of the second strip.

The single dovetail interlocking joint described in the immediately preceding paragraph is shown in FIGS. 16–20. The joint is formed in interlocking strips 40 and 41. Strip 40 (FIG. 16) includes a cutout 42 having parallel sides 43 extending from its surface 44 to an inner surface 45, and it also includes beveled edges 47 (FIGS. 16 and 20) which diverge outwardly from its rear surface 49 to the midpoint of the edges of the strip. The remaining portions 48 of the edges of strip 40 are parallel to each other. Strip 41 (FIG. 17) includes a planar surface 50 and a dovetail cutout 51 extending inwardly from the opposite surface 52 (FIG. 20) thereof. Dovetail cutout 51 includes dovetail sides 53 and an inner surface 54. The edges 55 of strip 41 are parallel to each other and portions of edges 55 at the joint engage sides 43 of strip 40. As noted above, strip 41 is locked onto strip 40 by bending it outwardly from the plane of the drawings to spread dovetail sides 53 and thereafter moving strip 41 into cutout 42 until surface 54 thereof engages surface 45 of strip 40 and thereafter permitting the resilient strip 41 to return to its normal unflexed position wherein dovetail sides 53 engage beveled edge portions 47. The surfaces of the strips are preferably flush with each other after the joint has been assembled.

In FIGS. 24–28 an alternate type of strip construction 60 is shown for providing a double interlocking dovetail joint in the same manner as described above relative to FIGS. 1–13. The only difference whatsoever between strip 60 and strips 11 and 12 of the preceding figures is that strip 60 is hollow for the purpose of conserving the plastic material from which it is fabricated. Strip 60 is flexible and resilient and includes a front wall 61 having a front surface, a rear wall 62 having a rear surface and side walls 63. Side walls 63 include wall portions 64 which diverge away from rear wall 62 and they also include wall portions 65 which diverge away from front wall 61. Dovetail cutouts 66 are formed at spaced locations as shown in FIG. 24 by cutting away spaced portions of upper wall 61 and portions of wall portions 65 to provide inclined edges 67 and edges 69 and 70. Edges 69 considered together constitute an inner surface at which the dovetail cutouts 66 effectively terminate. Inclined edges 67, which are opposed dovetail sides, extend at the same angle as side wall portions 64. The spacing between facing edges 70 of each dovetail is equal to the total width of bottom wall 62. Furthermore, as can be seen from FIG. 28, edges 70 are inclined at the same angle as edges or dovetail sides 67 so as to provide a good tight joint when two strips 60 are assembled with each other in double interlocking dovetail relationship as described above relative to FIGS. 1–13. More specifically, when two strips 60 are assembled, the edges 69 of one strip will extend perpendicularly to and in contact with edges 69 of the strip 60 which it crosses, and edges 67 of each strip will engage side wall portions 64 of the other strip.

In FIGS. 29–38, another embodiment is shown wherein hollow strips 74 and 75 will provide single dovetail interlocking joints when the strips 74 and 75 are assembled in the same manner as described above relative to FIGS. 16–20. In fact, strips 74 and 75 which are flexible and resilient, are identical in structure and mode of operation to strips 40 and 41 of FIGS. 16 and 17 except that they are hollow rather than solid for the purpose of conserving material.

Strip 74 (FIGS. 29, 30 and 31) includes a rear wall 76 having a rear surface, a front wall 77 having a front surface and side walls 79 which include side wall portions 80 which diverge from rear wall 76 and which include side wall portions 81 which are perpendicular to front wall 77. Spaced cutouts 82 are located in strip 74 and are bounded by straight edges 83, 84 and 85.

Strip 75 (FIGS. 32, 33 and 34) includes a rear wall 86 having a rear surface, a front wall 87 having a front surface and side walls 89 which include side wall portions 90 which diverge from rear wall 87 and which include wall portions 91 which are perpendicular to front wall 87. Dovetail cutouts 92 are formed as shown and are bounded by edges 93, edges 94 and edges 95, which are opposed dovetail sides. Edges 94 considered together constitute an inner surface at which the dovetail cutout 82 effectively terminates.

Strips 74 and 75 are assembled in the same manner as described above relative to FIGS. 16–20, and in assembled relationship strips 74 and 75 occupy the positions shown in FIGS. 35–38. It is to be especially noted that the edges, or dovetail sides, 95 of the wall portions 90 make a good tight fit with side wall portions 80, as shown in FIG. 36. Furthermore, the edges 83 and 84 of strip 74 make a good tight fit with side wall portions 91, as shown in FIG. 37. The wall 86 of strip 75 lies flush with wall 77 of strip 74, and wall 76 of strip 74 lies flush with wall 87 of strip 75, as shown in FIGS. 35–38.

It will be appreciated that while the structure of only a single dovetail interlocking joint has been shown in FIGS. 29–38, the strips 74 and 75 have cutouts 82 and 92, respectively, at axially spaced locations so as to permit the strips 74 and 75 to be assembled into a lattice structure.

While preferred embodiments of the present invention have been disclosed, it will be understood that it is not limited thereto but may be otherwise embodied within the scope of the following claims.

What is claimed is:

1. A self-retaining interlocked lattice comprising a plurality of first strips each having a first longitudinal axis and a first front surface and a first rear surface and first opposite edges, said first opposite edges of each of said first strips including first edge portions which diverge away from each other as they extend from said first rear surface toward said first front surface, a plurality of spaced first dovetail cutouts extending inwardly into each first strip from said first front surface and extending across said first opposite edges, each of said first dovetail cutouts having first opposite dovetail sides which diverge from each other as they extend from said first front surface toward said first rear surface and which effectively terminate at a first inner surface on said first strips, a plurality of second strips each having a second longitudinal axis and a second front surface and a second rear surface and second opposite edges, said second opposite edges of each of said second strips including second edge portions which diverge away from each other as they extend from said second rear surface toward said second front surface, a plurality of second dovetail cutouts extending inwardly into each second strip from said second front surface and extending across said second opposite edges, each of said second dovetail cutouts having second opposite dovetail sides which diverge from each other as they extend from said second front surface toward said second rear surface and which effectively terminate at a second inner surface on said second strips, said first and second strips being oriented with said first and second longitudinal axes transverse to each other and with said first and second dovetail cutouts oriented with said first and second inner surfaces in facing relationship to each other and with said first opposite dovetail sides in locking engagement with said second edge portions and with said second opposite dovetail sides in locking engagement with said first edge portions.

2. A self-retaining interlocked lattice as set forth in claim 1 wherein said first opposite edges include third edge portions which diverge away from each other as they extend from said first front surface toward said first rear surface.

3. A self-retaining interlocked lattice as set forth in claim 2 wherein said second opposite edges include fourth edge portions which diverge away from each other as they extend from said second front surface toward said second rear surface.

4. A self-retaining interlocked lattice as set forth in claim 3 wherein said first and second strips are hollow.

5. A self-retaining interlocked lattice as set forth in claim 3 wherein said first and second strips are of substantially the same thickness, and wherein said first and second dovetail cutouts are of substantially the same depth, and wherein said first and second and third and fourth edge portions are of substantially the same inclination and of substantially the same widthwise dimension, to thereby cause said first front surfaces of said first strips to lie substantially flush with said second rear surfaces of said second strips, and to cause said second front surfaces of said second strips to lie substantially flush with said first rear surfaces of said first strips.

6. A self-retaining interlocked lattice as set forth in claim 5 wherein the angles of inclination of said first dovetail sides are substantially equal to the angles of inclination of said second edge portions of said second strips.

7. A self-retaining interlocked lattice as set forth in claim 6 wherein the angles of inclination of said second dovetail sides are substantially equal to the angles of inclination of said first edge portions of said first strips.

8. A self-retaining interlocked lattice as set forth in claim 1 wherein the angles of inclination of said first dovetail sides are substantially equal to the angles of inclination of said second edge portions of said second strips.

9. A self-retaining interlocked lattice as set forth in claim 8 wherein the angles of inclination of said second dovetail sides are substantially equal to the angles of inclination of said first edge portions of said first strips.

10. A self-retaining interlocked lattice as set forth in claim 1 wherein said first and second inner surfaces are in substantial abutting relationship.

11. A self-retaining interlocked lattice as set forth in claim 1 wherein said first strips are parallel to each other, and wherein said second strips are parallel to each other.

12. A self-retaining interlocked lattice as set forth in claim 11 wherein said first and second strips are not perpendicular to each other.

13. A self-retaining interlocked lattice as set forth in claim 1 wherein said first and second strips are flexible and resilient.

14. A self-retaining interlocked lattice as set forth in claim 13 wherein said first and second strips are hollow.

15. A self-retaining interlocked lattice as set forth in claim 1 wherein said first and second strips are hollow.

16. A method of making and assembling a double-dovetail interlocked joint comprising the steps of providing first and second flexible resilient strips, forming first and second dovetail cutouts in said first and second strips, respectively, with said first dovetail cutouts having first dovetail sides and said second dovetail cutouts having second dovetail sides, forming first and second divergent edge portions on said first and second strips, respectively, placing said first and second dovetail cutouts in facing relationship with said first and second strips oriented transversely to each other, applying bending forces to said first and second strips in directions away from each other to thereby open said first and second dovetail cutouts, effecting relative movement of said first and second strips into said dovetail cutouts of the other of said strips, and releasing said bending forces to cause said resilient strips to return to their original unbent conditions to form interlocked relationships between said first dovetail sides and said second divergent edge portions and between said second dovetail sides and said first divergent edge portions.

17. A self-retaining interlocked lattice comprising a plurality of first strips each having a first longitudinal axis and a first front surface and a first rear surface and first opposite edges, said first opposite edges of each of said strips including first opposite edge portions which diverge away from each other as they extend from said first rear surface toward said first front surface, a plurality of cutouts each of which extend inwardly into said each first strip from said front surface and which extend across said first opposite edges and which effectively terminate at a first inner surface on said first strip, a plurality of second strips each having a second longitudinal axis and a second front surface and a second rear surface and second opposite edges, a plurality of spaced dovetail cutouts each of which extend inwardly into each second strip from said second front surface and extend across said second opposite edges and which effectively terminate at a second inner surface on said second strip, said first and second strips being oriented with said first and second longitudinal axes transverse to each other and with each of said cutouts and each of said dovetail cutouts oriented with said first and second inner surfaces facing each other and with a portion of said first strip in each of said dovetail cutouts and a portion of said second strip in each of said cutouts and with said dovetail sides of each of said dovetail cutouts of said second strips in locking engagement with said diverging edge portions of said first strips.

18. A self-retaining interlocked lattice as set forth in claim 17 wherein said first strips are parallel to each other and wherein said second strips are parallel to each other.

19. A self-retaining interlocked lattice as set forth in claim 18 wherein said first and second strips are not perpendicular to each other.

20. A self-retaining interlocked lattice as set forth in claim 17 wherein said second strips are flexible and resilient.

21. A self-retaining interlocked lattice as set forth in claim 17 wherein said first and second strips are hollow.

* * * * *